US010588413B2

(12) United States Patent
Mason et al.

(10) Patent No.: US 10,588,413 B2
(45) Date of Patent: Mar. 17, 2020

(54) CAMP AIR CHAIR

(71) Applicant: Walmart Apollo, LLC, Bentonville, AR (US)

(72) Inventors: Jennifer Mason, Bentonville, AR (US); Mary Billingsley McDaniel, Bentonville, AR (US); Chad Manning, Springdale, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 16/137,518

(22) Filed: Sep. 20, 2018

(65) Prior Publication Data

US 2019/0090644 A1 Mar. 28, 2019

Related U.S. Application Data

(60) Provisional application No. 62/562,158, filed on Sep. 22, 2017.

(51) Int. Cl.

| | |
|---|---|
| ***A47C 4/54*** | (2006.01) |
| ***A47C 7/46*** | (2006.01) |
| ***A47C 7/14*** | (2006.01) |
| ***A47C 4/28*** | (2006.01) |

(52) U.S. Cl.

CPC ..... *A47C 4/54* (2013.01); *A47C 4/28* (2013.01); *A47C 4/286* (2013.01); *A47C 7/142* (2018.08); *A47C 7/467* (2013.01)

(58) Field of Classification Search

CPC .... A47C 4/54; A47C 4/28; A47C 4/00; A47C 7/142; A47C 7/467; A47C 7/00; A47C 7/46

USPC ..... 297/19

See application file for complete search history.

(56) References Cited

U.S. PATENT DOCUMENTS

| | | | |
|---|---|---|---|
| 4,687,452 | A | 8/1987 | Hull |
| 6,382,729 | B1 | 5/2002 | Wu |
| 6,446,282 | B1 | 9/2002 | Wu |
| 6,814,408 | B2 | 11/2004 | Chen |
| 7,581,259 | B2 | 9/2009 | Thompson |
| 7,857,378 | B2 | 12/2010 | Smith |
| 8,783,781 | B1 | 7/2014 | McClure et al. |
| 8,979,192 | B2 | 3/2015 | Miller |
| 2007/0001505 | A1 | 1/2007 | Marshall et al. |
| 2011/0025111 | A1 | 2/2011 | Wornell et al. |

(Continued)

FOREIGN PATENT DOCUMENTS

| | | | |
|---|---|---|---|
| DE | 102009052738 | A1 | 5/2011 |
| WO | 9614783 | A1 | 5/1996 |

OTHER PUBLICATIONS

Machine Translation of DE102009052738 (Year: 2009).*

(Continued)

*Primary Examiner* — Mark R Wendell

(57) ABSTRACT

Systems and methods herein provide a customizable camp chair that may provide added levels of comfort to portable seating. In some examples, portions of the camp chair are inflatable to provide customized support at various areas of the chair. In other examples, portions of the camp chair are configured to receive inserted inflation devices for customized support at various areas of the chair. The chair may include an integrated air pump, which aids in inflation.

20 Claims, 7 Drawing Sheets

(56) References Cited

U.S. PATENT DOCUMENTS

| | | | |
|---|---|---|---|
| 2013/0036556 | A1 | 2/2013 | Ashby |
| 2014/0346836 | A1 | 11/2014 | Briggs et al. |

OTHER PUBLICATIONS

Young, Lee W., "International Search Report", International Application No. PCT/US 18/52093, dated Jan. 8, 2019, 2 pages.
Young, Lee W., "Written Opinion of the International Searching Authority", International Application No. PCT/US 18/52093, dated Jan. 8, 2019, 6 pages.

* cited by examiner

CAMP AIR CHAIR

BACKGROUND

A portable chair, or camp chair, typically provides portable seating in a minimal form factor. A camp chair may expand and contract in order to collapse for storage and transport. Generally, a camp chair comprises a frame with attached fabric that serves as a seat and back of the chair, and often the frame will include two arm rests as well.

SUMMARY

Examples of this disclosure provide a customizable camp chair that may provide added levels of comfort to portable seating. In some examples, portions of the camp chair are inflatable to provide customized support at various areas of the chair. In other examples, portions of the camp chair are configured to receive inserted inflation devices for customized support at various areas of the chair.

BRIEF DESCRIPTION OF THE DRAWINGS

Corresponding reference characters indicate corresponding parts throughout the drawings.

DETAILED DESCRIPTION

Examples of the disclosure provide a portable chair that has ergonomically placed air pockets to provide support that can be adjusted to a desired level of firmness. The air pockets, or inflatable portions, add extra levels of comfort to portable seating. One or more areas of the chair may be adjusted, either individually or together, to achieve a desired level of inflation. With easy inflation, the portable chair quickly and easily provides the support and comfort desired.

The inflatable portions may be individual cells or chambers built into the chair seating and/or backing to provide support and comfort in various configurations and locations. Each individual cell or chamber may be inflated alone, a plurality of cells or chambers may be inflated simultaneously, and/or a portion of a plurality of individual cells may be inflated individually while another portion of the plurality of individual cells may be inflated together, or any combination of the preceding.

The inflatable portions may be deflated in various customizable configurations as well. In some examples, a single deflation component may allow air flow to exit the one or more inflatable chambers of the chair. In other examples, one or more deflation components may be associated with one or more individual cells or air chambers to allow air to escape in some areas of the chair while maintaining inflation in other areas of the chair. In some examples, a deflation component may forcibly remove air from one or more inflated areas of the chair. A deflation component may be, for example, a knob, button, nozzle, removable seal, vacuum, or any other suitable component for controlling air flow into and/or out of an inflatable portion.

Figure 1A:
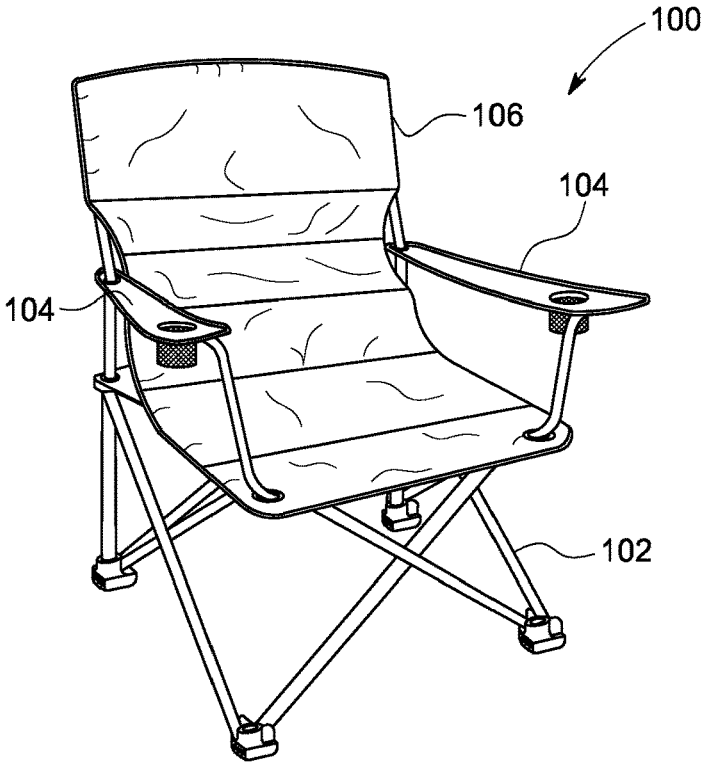
FIG. 1A is an exemplary diagram illustrating an inflatable portable chair in a deflated state in accordance with the disclosure.

Referring to FIG. 1A, an exemplary diagram illustrates an inflatable portable chair in a deflated state or uninflated state. Chair 100 includes a frame 102. The frame 102 may be an expandable and contractible structure, such as a collapsible frame for a portable chair. Frame 102 may include arm rests 104. Seat 106 is coupled to or affixed to frame 102 to provide a surface area with configurable bottom and back support. Seat 106 may be comprised of any suitable fabric or material.

Seat 106 may include one or more inflatable portions. The inflatable portions may be individually separated to provide customizable levels of inflation in each portion, in some examples. In other examples, one or more inflatable portions may be internally connected to allow air flow between the connected inflatable portions, with internal structures that provide configurable air support to each of the inflatable portions. A deflated state may refer to a state in which substantially no air is contained or maintained within one or more of the inflatable portions. It should be understood that a deflated state may comprise a threshold level of air within an inflatable portion, however the air may not be forcibly maintained or contained in the deflated state.

Figure 1B:
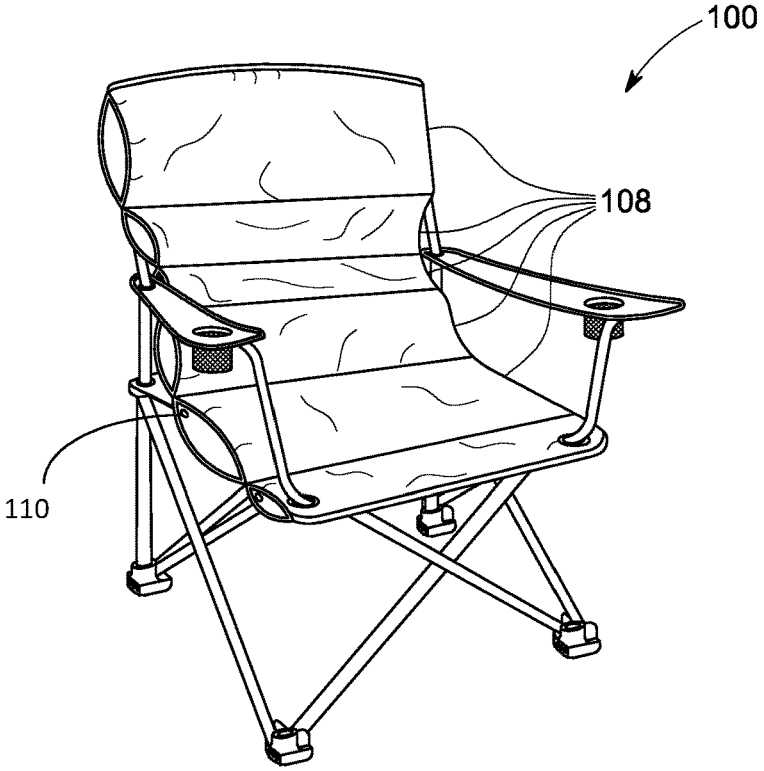
FIG. 1B is an exemplary diagram illustrating an inflatable portable chair in an inflated state in accordance with the disclosure.

FIG. 1B is an exemplary diagram illustrating a portable chair in an inflated state. Chair 100 may include inflatable portions and uninflatable portions, in some examples. Chair 100 is depicted with inflatable portions 108 in an inflated state. The inflated state may refer to a state in which at least some air is contained and/or maintained within one or more of the inflatable portions. The inflated state may have various degrees of inflation, such that customizable levels of air pressure, or inflation, may be achieved in one or more of the inflatable portions.

The inflatable portions 108 may be comprised at least in part of a compressible material that is impervious to penetration by air, such that air or other fluids may be maintained within a sealed enclosure formed by the material. The material may be any type of material, or combination of materials, such as nylon, polyester, polyethylene, impregnated fabric, coated fabric, or any other suitable textile or material for example.

In some examples, each inflatable portion of the inflatable portions 108 may have an individual valve 110 disposed at an outer location, or at an outer layer, along the inflatable portion. The valve is an air flow control component that provides for adjustment of air flow to a corresponding portion or number of portions. In other examples, an individual inflatable portion may have one or more air chambers, and a valve may control air flow to the one or more air chambers. In some other examples, an electric pump may include an automatic fill valve and tube connected to the inflatable portions that would fill each inflatable portion and/or air chambers of the inflatable portions.

The valve may be implemented at a location of an inflatable portion opposite to or away from a surface area location that may be in contact with a user when the user is seated. For example, the valve or number of valves may be located at the back of the chair, underneath a seat portion of the chair, or at a side of the chair, or any other suitable location.

Figure 2:
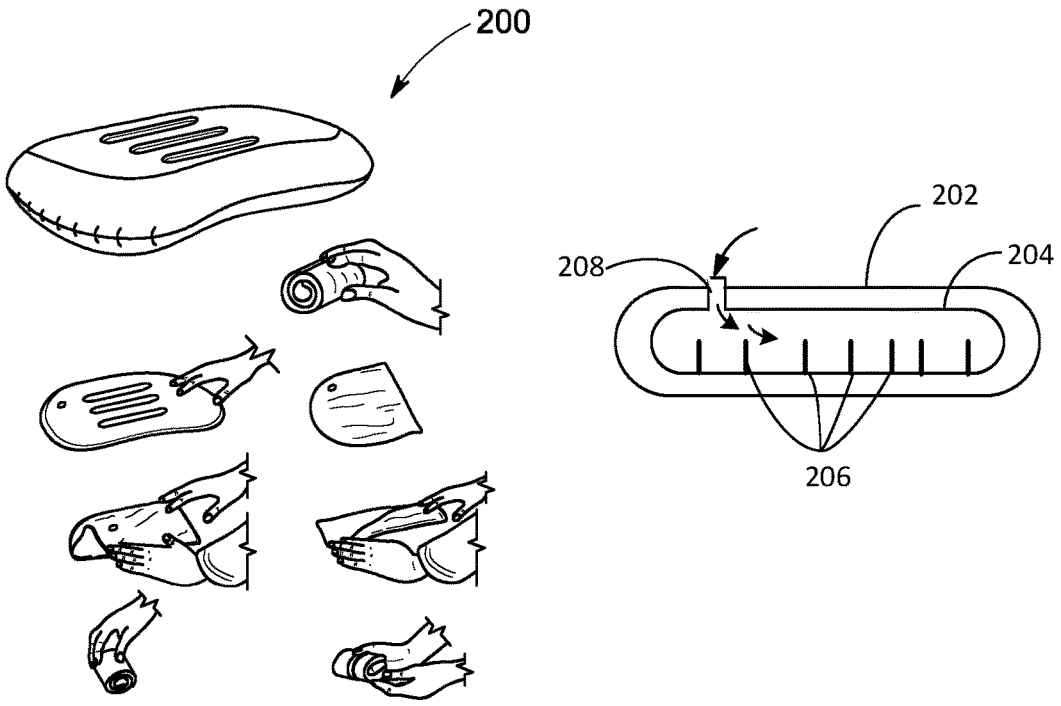
FIG. 2 is an exemplary diagram illustrating inflatable inserts for a portable chair in accordance with the disclosure.

FIG. 2 illustrates inflatable inserts for a portable chair in accordance with the disclosure. In some examples, portions of the portable chair may be configured with a space, opening, or enclosure to receive an inflatable insert. For example, chair 100 in FIG. 1 may have insertion points at one or more locations along seat 106. The insertion points may be configured as a pocket having an opening at one end, in some examples. In other examples, the insertion points may be configured as a sleeve, having an opening at opposite ends to allow for insertion of an inflatable element on either side.

Inflatable insert 200 may be comprised of a compressible material that is impervious to penetration by air, such that air or other fluids may be maintained within a sealed enclosure formed by the material. The material may be any type of material, such as nylon, polyester, polyethylene, impregnated fabric, coated fabric, or any other suitable material for example.

Inflatable insert 200 may include an outer layer 202 and an inner layer 204 of material, in some examples, with one or more air chambers or air pockets formed by an enclosure of the inner layer and baffling elements 206 disposed within. One or more inflation means 208 may also be disposed between the inner layer and outer layer. The inflation means may further be connected to a valve 2 disposed on the outer layer on one end and a valve disposed on the inner layer at another end, in some examples, to provide for air flow from outside the air chambers to flow into the air chambers, and vice versa. In some examples, air may be compressibly force out of inflatable insert 200

One or more inflatable inserts 200 may be inflated to a desired level and inserted into a space or opening, such as insert pockets, of the portable chair. The inflatable inserts may be deflated and compressed for storage when not in use. In some examples, a pouch or other pocket may be incorporated into the fabric or material of the seat to accommodate an inflatable insert in an inflated state. Optionally, a pouch or other pocket for accommodating one or more inflatable inserts in a deflated state may be incorporated into the fabric of material of the seat, or alternatively disposed along the frame of the chair at some location in order to maintain the inserts in proximity to the chair when not in use.

Figure 3:
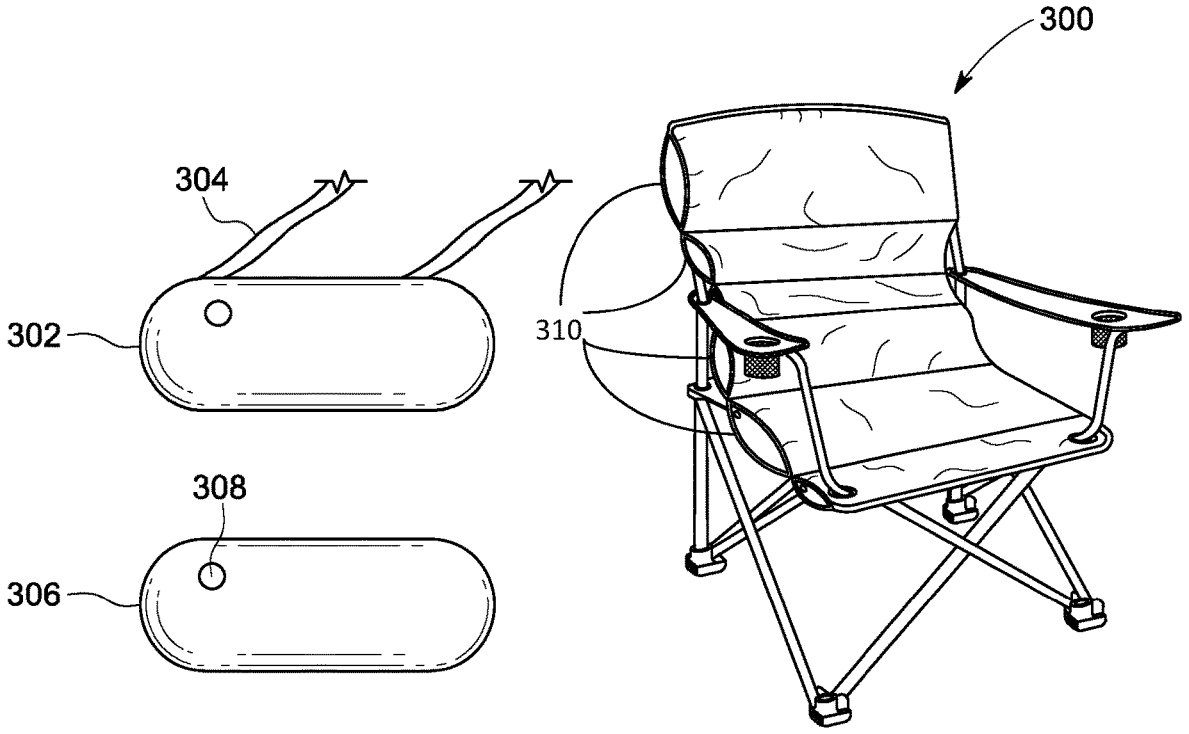
FIG. 3 is an exemplary diagram illustrating a portable chair configured to receive inflatable inserts in accordance with the disclosure.

FIG. 3 illustrates a portable chair configured to receive inflatable inserts, such as inflatable inserts 200 in FIG. 2. Chair 300 may have one or more insertable regions 310 disposed along the material and/or configured from the material that provides seating and back support. Each insertable region may be configured to receive or house an inflatable insert, such as inflatable insert 306. The insertable regions may be formed by layers of material fixed together at two or three sides and remaining open on at least one side to provide a pocket or sleeve to receive and/or house an insert. The one or more insertable regions may be uniform in size, in some examples, to provide for interchangeable inserts regardless of the region location along the chair. In other examples, the insertable regions may have different sizes to accommodate different sizes or shapes of inflatable inserts. The insertable regions are configured to accommodate a corresponding inflatable insert in a fully inflated state, such that customizable inflation levels may be achieved.

Optionally, an inflatable portion may be disposed and/or removably attached to an exterior portion of chair 300. In this example, inflatable portion 302 may be removably attached to chair 300, such as by using straps 304 or any other suitable fastener. For example, inflatable portion 302 may be an inflatable headrest that may be separately affixed to chair 300. A removeable inflatable portion may be an inflatable pillow that can be customized with filled air at a desired level either by pump, or a self-inflating valve, for example. In this example, straps or other fasteners may attach the removeable inflatable portion to a fixed portion of the chair, such as the upper back portion or headrest portion of the frame or other element of the chair.

Inflatable insert 306 is an example of an inflatable insert that may be inserted into one or more of the insertable regions of chair 300. Inflatable insert 306 includes valve 308. Valve 308 controls air flow into and out of inflatable insert 306 using any suitable means. Valve 308 may be any type of device or component configured to control the direction and/or characteristics of air flow into or out of, or both into and out of, an enclosed chamber of inflatable insert 306. Valve 308 may include an open state and a closed state, where the open state allows air flow and the closed state prevents air flow, for example.

In some examples, valve 308 may be a knob that constricts or allows air flow. In other examples, valve 308 may be a removable seal. In still other examples, valve 308 may be a nozzle that provides for self-inflation of inflatable insert 306 when in an open state, maintains inflation of inflatable insert 306 when in a closed state, and when combined with compression allows air to escape for deflation when in an open state. For example, inflatable insert 306 may include one or more self-inflating chambers coupled to valve 308, each air chamber being separately adjustable once inflated to reduce air pressure in individual air chambers and/or increase air pressure in individual air chambers, where desired, in order to customize the inflation level of various portions of the inflatable insert.

Figure 4:
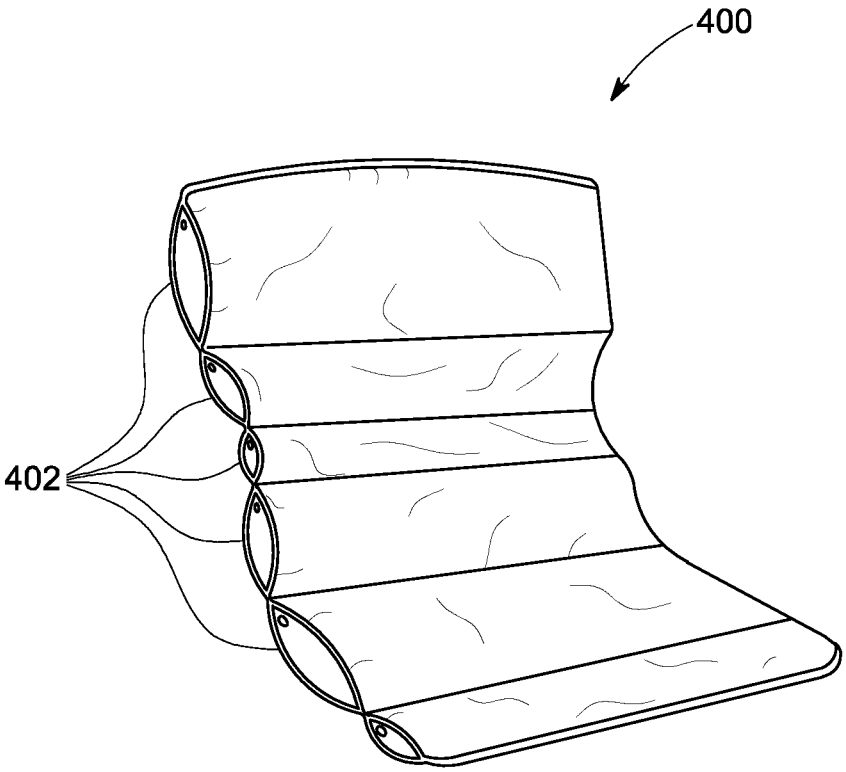
FIG. 4 is an exemplary diagram illustrating an inflatable portion of a portable chair in accordance with the disclosure.

FIG. 4 illustrates an inflatable portion of a portable chair, such as chair 100 in FIGS. 1A and 1B. In this illustrative example, inflatable portions, or inflatable regions, are built into a material of the chair that is affixed to the frame of the chair, providing an inflatable chair.

Chair 400 includes inflatable regions 402. Inflatable regions 402 may be individual regions, or portions, each having their own air flow control system in one example. In this example, individual portions of inflatable regions 402 may be separately inflated or deflated as desired to customize the individual inflation levels of the individual regions.

In other examples, one or more of the inflatable regions may be connected to a shared air flow control system, allowing the connected regions to be inflated simultaneously. In some examples, the air flow control system may provide for simultaneous inflation but individual deflation of a set of shared inflatable regions. For example, a valve or nozzle may be implemented or disposed at a portion of a first region, and one or more air chambers of the first region may be at least partially connected to a second region, whereby the introduction of air into the first region provides air flow through the first region to the second region. In other examples, inflation may occur simultaneously in two or more regions, with deflation configured to occur separately in each region using an air flow control system to allows air into all chambers at once, but provides for air flow out of the chambers individually.

One or more baffling elements may be disposed within the interior portion of the inflatable regions, forming cells or chambers that divide the interior inflatable portion of the inflatable regions, for example. In other examples, individual air chambers may be relatively sealed off from each other and include a small channel disposed or implemented between the individual air chambers to control air flow between the chambers.

Chair 400 may include uninflatable portions as well, such as along the edges where the material meets the frame, or is connected to the frame, or along optional arm rests, or any other suitable area, for example.

Figure 5:
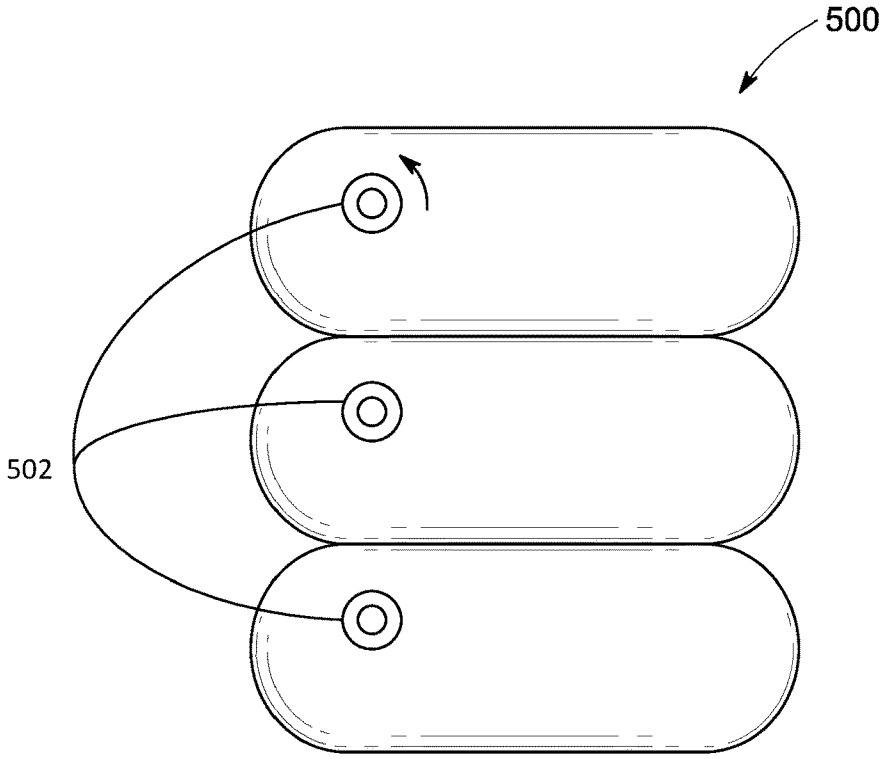
FIG. 5 is an exemplary diagram illustrating inflatable portions of a portable chair in accordance with the disclosure.

FIG. 5 is an exemplary diagram illustrating inflatable portions of a portable chair. As illustrated in the diagram, inflatable portions 500 may include three individual inflatable portions, each having its own air flow control 502. In other examples, inflatable portions may comprise a single inflatable portion affixed to other non-inflatable regions of a chair material. In still other examples, inflatable portions may comprise two individual portions, such as one portion for an inflatable seat and one portion for an inflatable back of a chair. In yet other examples, inflatable portions may include more than three individual portions. The diagrams provided herein are merely for illustrative purposes to describe aspects of the disclosure and are not intended to limit aspects of the disclosure in any way.

In the example of inflatable portions 500, each inflatable portion includes an individual air flow control 502. In other examples, more or less air flow controls may be provided. For example, an inflatable portion may have two air flow controls, one at either end of the inflatable portion. In other examples, one inflatable portion may be internally coupled to another inflatable portion, where a single air flow control disposed on an exterior of one inflatable portion provides air flow to the internal other inflatable portion.

The air flow control may be a knob, dial, nozzle, seal, plug, and/or any other suitable means of controlling air flow. In the example of a knob or nozzle, the air flow control may be configured to turn one way to provide an open state and the opposite way to provide a closed state. In these examples, air flow may be manually controlled by the air flow controls implemented on the inflatable portions.

Figure 6:
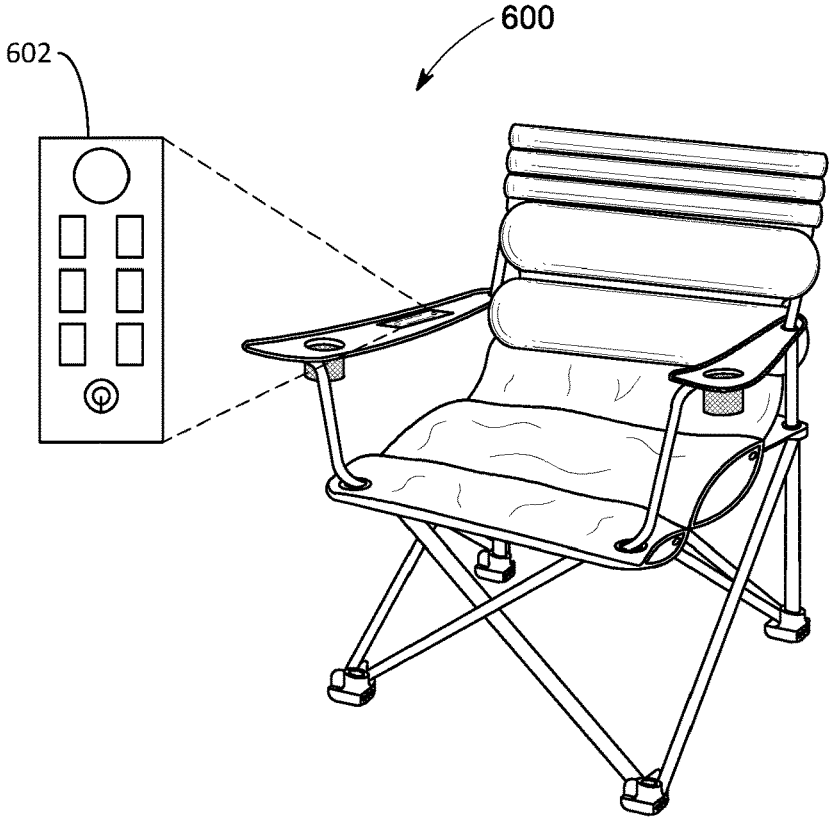
FIG. 6 is an exemplary diagram illustrating a customizable control of an inflatable portable chair.

FIG. 6 is an exemplary diagram illustrating a customizable control of an inflatable portable chair. Chair 600 may be an illustrative example of chair 100 in FIGS. 1A and 1B.

Chair 600 may include customizable controls, or a controller, implemented remote from the inflatable portions and communicatively coupled to air flow controls that are in physical communication with the inflatable portions. Customizable controls 602, or controller, may be used to selectively inflate and/or deflate one or more different inflatable regions of chair 600, for example.

In some examples, chair 600 includes one or more motors disposed in each insertable region and communicatively coupled to the customizable controls in order to receive signals from the controls 602 and control air flow in response to the received signals. In other examples, chair 600 includes one or more valves communicatively coupled to the customizable controls 602 and configured to receive signals and control the air flow in response to the signals received. In yet other examples, chair 600 may include one or more valves for inflation, and customizable controls 602 may be used to selectively deflate one or more regions or portions of the chair after full inflation of all regions to achieve a desired inflation level at various portions of the chair. The customizable controls may include buttons, dials, levers, switches, and/or any other suitable control.

Figure 7:
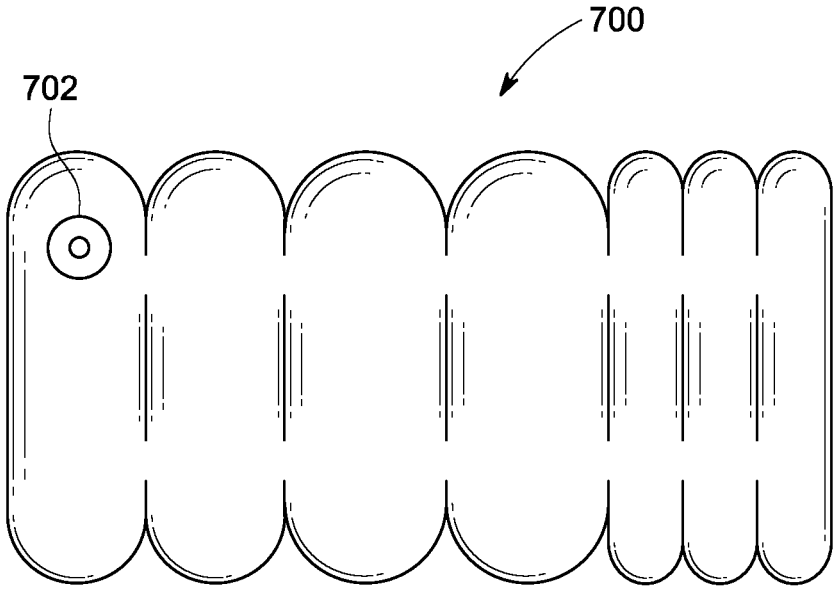
FIG. 7 is an exemplary diagram illustrating an inflatable portion of a portable chair in accordance with the disclosure.

FIG. 7 is an exemplary diagram illustrating an inflatable portion of a portable chair in accordance with the disclosure. Seat 700 may be part of an inflatable portable chair, such as chair 100 in FIGS. 1A and 1B, for example.

Seat 700 may include multiple air chambers disposed within the inflatable portions with an air flow control system 702 configured to control air flow into and out of the internal air chambers. In this example, individual chambers of the inflatable portion may be in fluid communication with each other to allow air flow to pass through one chamber and into another chamber, for example.

Figure 8:
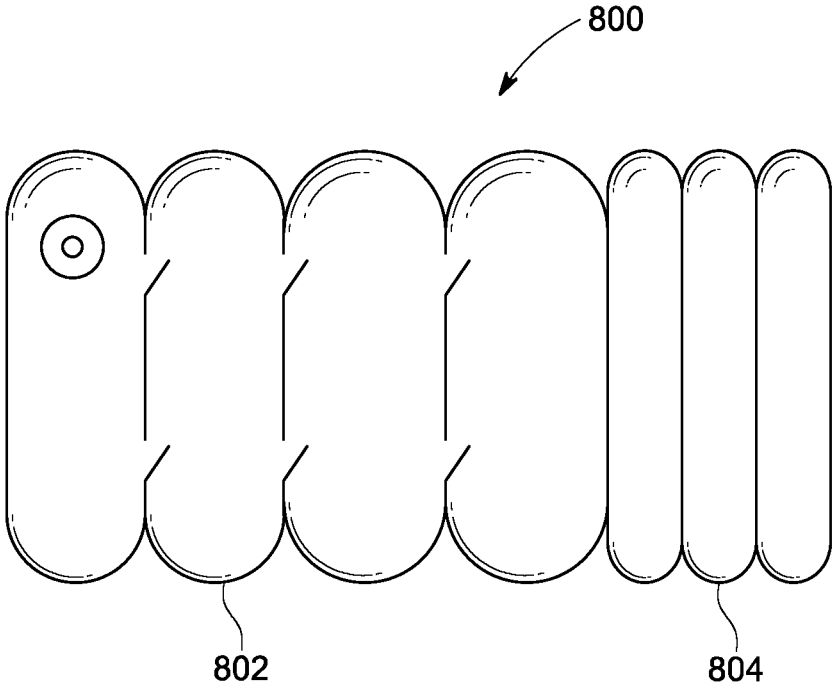
FIG. 8 is an exemplary diagram illustrating a portion of a portable chair having customizable inflatable zones and fixed inflatable zones in accordance with the disclosure.

FIG. 8 is an exemplary diagram illustrating a portion of an inflatable portable chair having customizable inflatable zones and non-customizable inflatable zones in accordance with the disclosure. Seat 800 includes a number of customizable regions 802 and a number of non-customizable regions 804. Customizable regions 802 may be selectively inflated and deflated to different levels as desired. Non-customizable regions 804 may be inflated at a fixed level that is not adjustable, or may include foam or other fill that is not adjustable. For example, non-customizable regions 804 may be a fixed inflated headrest, where the other inflatable portions may be adjustable but the headrest remains at a fixed level of inflation.

Figure 9:
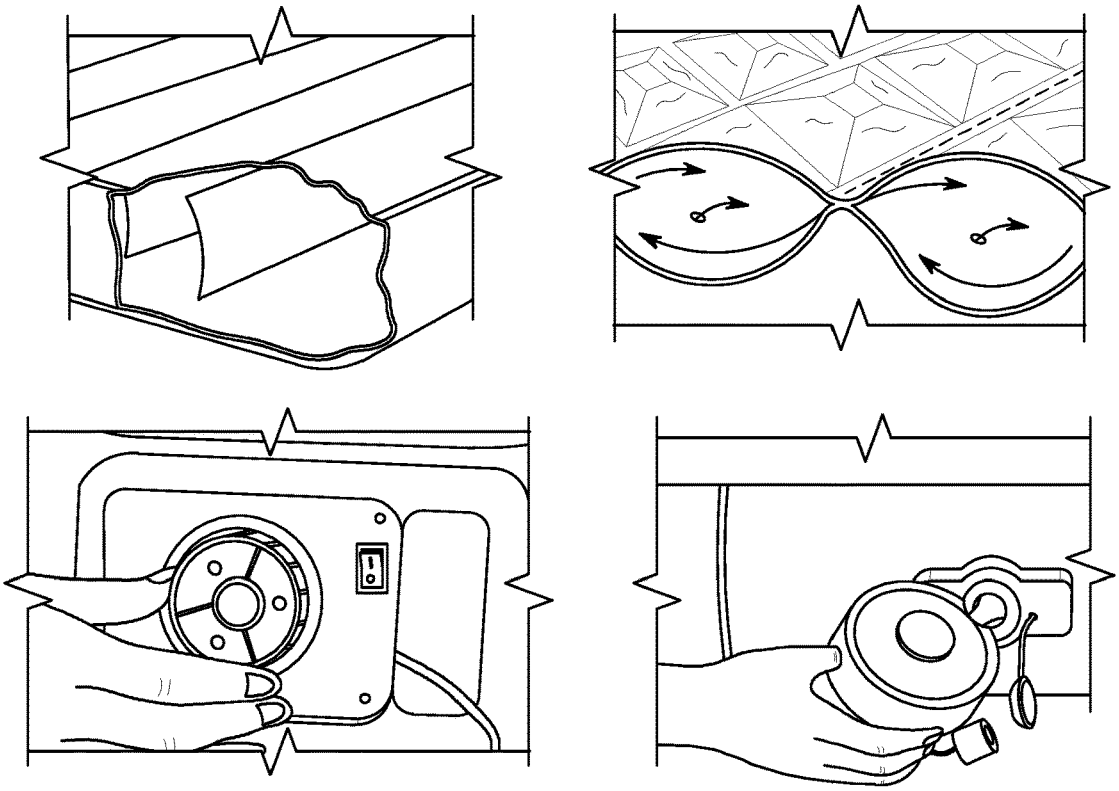
FIG. 9 is an exemplary diagram illustrating options for controlling inflation of a portable chair in accordance with the disclosure.

FIG. 9 is an exemplary diagram illustrating options for controlling inflation of an inflatable portable chair, or inflatable inserts for a portable chair, in accordance with the disclosure. As discussed above, the interior region of inflatable portions of the chair, or inflatable inserts for the chair, may include a number of baffling elements in some examples to provide separable air chambers, or channels, and control air flow throughout the interior region of the inflatable portions. In other examples, seams or seals may be disposed at various locations to provide separation between different internal air chambers of the inflatable portions or inflatable inserts. Air flow from one chamber to another chamber may be controlled by an inflation system implemented within the inflatable portions, in some examples.

The air flow control system of the camp air chair, or inflatable portable chair, may be configured to interact with an air pump, a motorized pump, a hand pump, a compressor, or any other suitable means of introducing air into the inflatable regions. In some examples, the air flow control system may be integrated with the chair or the inflatable regions of the chair. The air flow control system may include a dial to control inflation levels of various inflatable regions. In some examples, the dial may provide configurable settings for different regions in order to customize the introduction of air into that selected region when powered on. In other examples, the dial may provide configurable settings for different levels of inflation or air pressure in order to customize the amount of air introduced into, or allowed to flow out of, inflatable regions. A power source may be implemented in the air flow control system, in some examples. In other examples, the air flow control system may have power connection or adapter means for connecting to an external power source.

Figure 10:
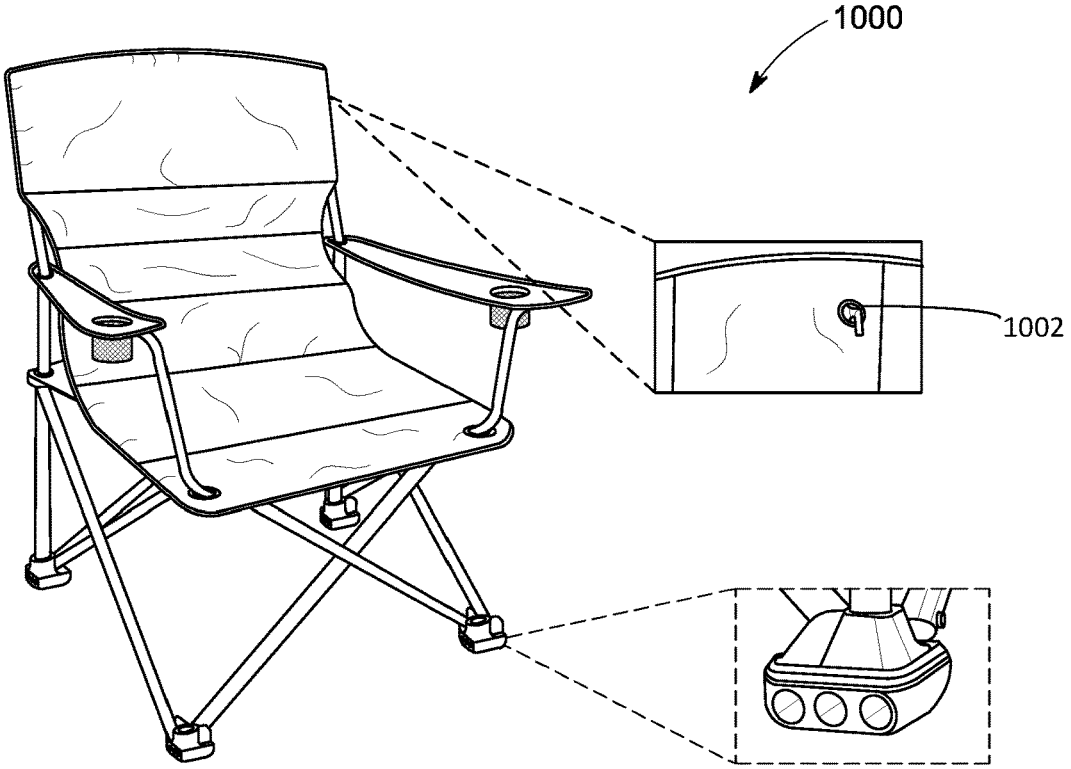
FIG. 10 is an exemplary diagram illustrating a mono-chamber inflatable chair in accordance with the disclosure.

FIG. 10 is an exemplary diagram illustrating a mono-chamber inflatable chair in accordance with the disclosure.

Chair 1000 may have a single inflatable region that inflates to a desired level. In this example, a nozzle 1002 with a cap or a seal may be disposed along a portion of the inflatable region to control air flow to and from the inflatable region. The inflatable region may comprise a portion of the surface area of the seat material next to a portion of the surface area that is non-inflatable. For example, the middle portion may be inflatable along the length (seat and back) of the surface area of the chair material, with a strip or region on either side of the middle portion being non-inflatable.

Chair 1000 may also have chair feet configured for all terrain purposes.

Figure 11:
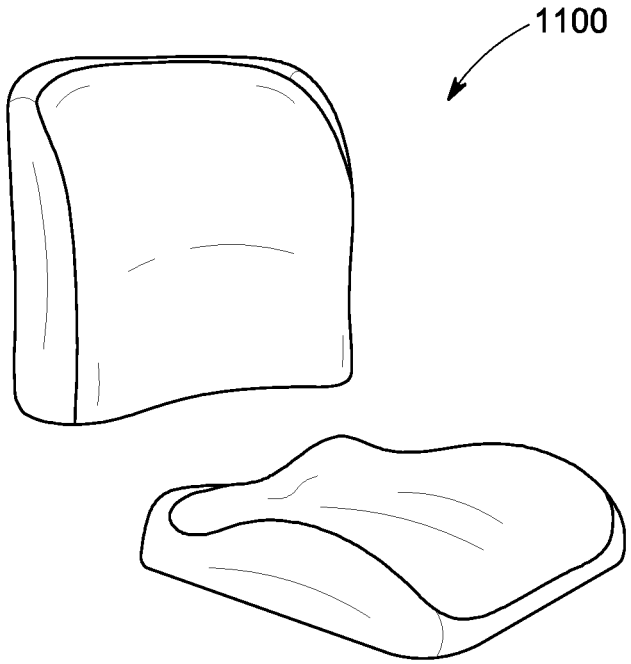
FIG. 11 is an exemplary diagram illustrating molded inserts for a portable chair in accordance with the disclosure.

FIG. 11 is an exemplary diagram illustrating molded inserts for a portable chair in accordance with the disclosure. In another example of a customizable portable chair, a chair such as chair 300 with insertable regions may be configured to accept molded inserts. Molded inserts 1100 may be comprised of foam, gel, or any other suitable material configured to maintain a certain shape while also having a degree of deformability.

Figure 12:
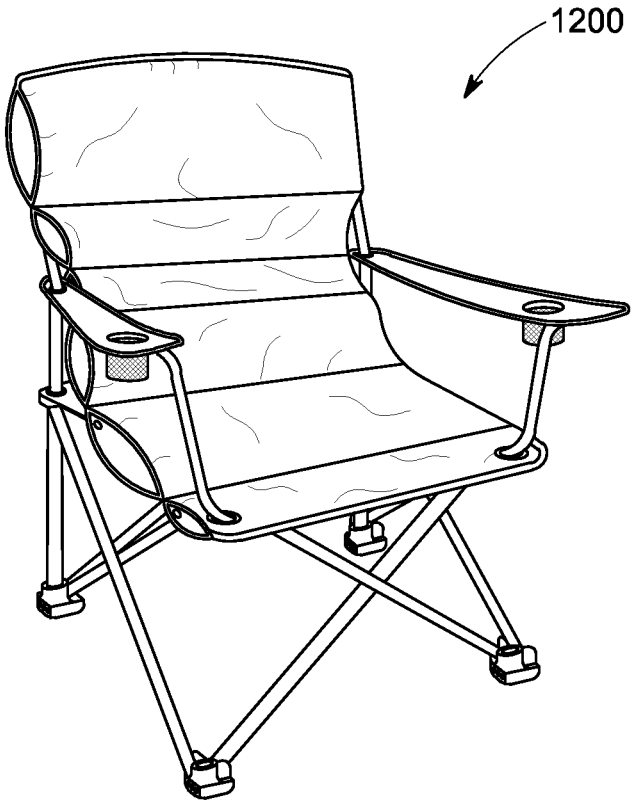
FIG. 12 is an exemplary diagram illustrating a portable chair configured to receive molded inserts in accordance with the disclosure.

FIG. 12 is an exemplary diagram illustrating a portable chair configured to receive molded inserts in accordance with the disclosure. Chair 1200 may include one or more insertable regions. The insertable regions may be formed by layers of material fixed together at two or three sides and remaining open on at least one side to provide a pocket or sleeve to receive an insert. The one or more insertable regions may be uniform in size, in some examples, to provide for interchangeable inserts regardless of the region location along the chair. In other examples, the insertable regions may have different sizes to accommodate different sizes or shapes of molded inserts.

Additional Examples

In some examples, each area of the inflatable camp chair is configured to be adjusted differently to customize both fit to an individual user and comfort to an individual user. For example, one user may desire to adjust lumbar support, inflating a region of the chair that rests against that user's lower back when that user is seated in the chair. Another user may sit in the same chair and desire lumbar support at a different level, or at a different region of the chair due to being a different sized user.

Alternatively, or in addition to the other examples described herein, examples include any combination of the following:

wherein the seat region comprises a back support region;

wherein at least one of the one or more inflatable regions is independently inflatable and deflatable;

wherein at least one of the one or more inflatable regions is self-inflatable;

wherein the inflatable folding chair system includes an air pump configured to inflate at least one of the one or more inflatable regions;

wherein the air pump is integrated into the frame;

wherein the air pump includes an electric motor;

wherein the inflatable folding chair system includes a controller communicatively coupled to the motor, wherein the controller receives user input corresponding to at least one of the one or more inflatable regions;

wherein the controller controls a user selected amount of air sealed within at least one of the one or more inflatable regions;

wherein at least two of the plurality of inflatable regions are simultaneously inflatable and deflatable;

wherein the one or more insertable regions is configured as a pocket having an opening at one end;

wherein the one or more insertable regions is configured as a sleeve having an opening at two opposite ends;

wherein the one or more insertable regions includes a fastening system securing the one or more inflatable inserts;

wherein inflatable camp chair includes one or more storage sections configured to store one or more inflatable inserts.

At least a portion of the functionality of the various elements in the figures may be performed by other elements in the figures, or an entity (e.g., processor, web service, server, application program, computing device, etc.) not shown in the figures.

In some examples, the operations for customized settings may be implemented as software instructions encoded on a computer readable medium, in hardware programmed or designed to perform the operations, or both. For example, aspects of the disclosure may be implemented as a system on a chip or other circuitry including a plurality of interconnected, electrically conductive elements incorporated into a control system of the inflatable chair. In some examples, a processor may be implemented as part of the chair control system to execute instructions received.

When introducing elements of aspects of the disclosure or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of." The phrase "one or more of the following: A, B, and C" means "at least one of A and/or at least one of B and/or at least one of C."

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. An inflatable folding chair system comprising:

a foldable rigid frame;

a seat region supported by the frame, wherein the seat region comprises material forming two or more inflatable regions, at least one of the two or more inflatable regions being independently inflatable and deflatable relative to other inflatable regions of the two or more inflatable regions, wherein each of the two or more inflatable regions is configured to be adjusted differently to customize fit and comfort to a user at various areas of the seat region; and an air control component communicatively coupled to at least one of the two or more inflatable regions.

2. The inflatable folding chair system of claim 1 wherein the seat region comprises a back support region.

3. The inflatable folding chair system of claim 1 wherein the two or more inflatable regions are individually separated to provide customizable levels of air pressure in each of the two or more inflatable regions.

4. The inflatable folding chair system of claim 1 wherein at least one of the two or more inflatable regions is self-inflatable.

5. The inflatable folding chair system of claim 1 further comprising:

an air pump configured to inflate at least one of the two or more inflatable regions.

6. The inflatable folding chair system of claim 5 wherein the air pump is integrated into the frame.

7. The inflatable folding chair system of claim 5 wherein the air pump includes an electric motor.

8. The inflatable folding chair system of claim 7 further comprising:

a controller communicatively coupled to the electric motor, wherein the controller receives user input corresponding to at least one of the two or more inflatable regions.

9. The inflatable folding chair system of claim 8 wherein the controller controls a user selected amount of air sealed within at least one of the two or more inflatable regions.

10. The inflatable folding chair system of claim 1 comprising:

a plurality of inflatable regions, wherein at least two of the plurality of inflatable regions are simultaneously inflatable and deflatable.

11. A customizable folding seating apparatus comprising:

a foldable rigid frame;

two or more inflatable inserts, at least one of the two or more inflatable inserts being independently inflatable and deflatable relative to other inflatable inserts of the two or more inflatable inserts; and a seat region supported by the frame, wherein the seat region comprises material forming two or more insertable regions, the two or more insertable regions configured to house the two or more inflatable inserts in an inflated state;

wherein each of the two or more inflatable inserts is configured to be adjusted differently to customize fit and comfort to a user at various areas of the seat region.

12. The inflatable folding chair system of claim 11 wherein the seat region comprises a back support region.

13. The inflatable folding chair system of claim 11 wherein the two or more insertable regions is configured as a pocket having an opening at one end.

14. The inflatable folding chair system of claim 11 wherein the two or more insertable regions is configured as a sleeve having an opening at two opposite ends.

15. The inflatable folding chair system of claim 11 wherein the two or more insertable regions includes a fastening system securing the two or more inflatable inserts.

16. The inflatable folding chair system of claim 11 wherein at least two of the two or more inflatable inserts are simultaneously inflatable.

17. The inflatable folding chair system of claim 11 further comprising:

one or more storage sections configured to store one or more inflatable inserts while the inflatable inserts are in a deflated state.

18. The inflatable folding chair system of claim 11 further comprising:

an air pump configured to inflate the two or more inflatable inserts.

19. The inflatable folding chair system of claim 18 wherein the air pump includes an electric motor.

20. An inflatable folding chair system comprising:

a foldable rigid frame;

a seat region supported by the foldable rigid frame, wherein the seat region comprises material forming two or more inflatable regions, and wherein the seat region comprises a back support;

at least one of the two or more inflatable regions being independently inflatable and deflatable relative to other inflatable regions of the two or more inflatable regions, wherein each of the two or more inflatable regions is configured to be adjusted differently to customize fit and comfort to a user at various areas of the seat region;

an air control system including an air pump and electric motor that is integrated into the foldable rigid frame and communicatively coupled to at least one of the two or more inflatable regions; and a controller communicatively coupled to the air control system that receives user input and controls air flow from the air control system to one or more inflatable regions to customize inflation levels based on the received user input.

* * * * *